US007462036B2

(12) United States Patent
Shin et al.

(10) Patent No.: US 7,462,036 B2
(45) Date of Patent: Dec. 9, 2008

(54) PRINTED CIRCUIT BOARD CONNECTOR FOR BACK LIGHT UNIT AND CHASSIS USING THE SAME

(75) Inventors: Chang Ho Shin, Incheon (KR); Hun Joo Hahm, Gyunggi-do (KR); Jung Kyu Park, Seoul (KR); Won Joon Lee, Seoul (KR); Hyung Suk Kim, Gyunggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 12/007,735

(22) Filed: Jan. 15, 2008

(65) Prior Publication Data

US 2008/0171451 A1 Jul. 17, 2008

(30) Foreign Application Priority Data

Jan. 16, 2007 (KR) ..... 10-2007-004665

(51) Int. Cl.
*H01R 12/00* (2006.01)

(52) U.S. Cl. ..... 439/65; 439/289

(58) Field of Classification Search ..... 439/65.289–295
See application file for complete search history.

(56) References Cited

U.S. PATENT DOCUMENTS

| | | | | | |
|---|---|---|---|---|---|
| 3,624,587 | A * | 11/1971 | Conrad | 439/65 |
| 4,998,886 | A * | 3/1991 | Werner | 439/65 |
| 5,026,290 | A * | 6/1991 | Dery | 439/65 |
| 5,403,195 | A * | 4/1995 | Thrush et al. | 439/620.2 |
| 5,473,242 | A * | 12/1995 | McKenna | 439/65 |
| 6,477,059 | B1 * | 11/2002 | Ono et al. | 439/65 |
| 6,524,114 | B2 * | 2/2003 | Watanabe et al. | 439/65 |
| 7,027,305 | B2 * | 4/2006 | Keating et al. | 439/65 |

* cited by examiner

*Primary Examiner*—Briggitte R Hammond
(74) *Attorney, Agent, or Firm*—McDermott Will & Emery LLP

(57) ABSTRACT

There are provided a printed circuit board connector for a backlight unit and a chassis using the same. The printed circuit board connector for a backlight unit including: a horizontal supporter; a vertical supporter having one end connected to the horizontal supporter to divide the horizontal supporter into first and second areas; at least one connecting terminal formed on the horizontal supporter to be partially exposed in each of the first and second areas of the horizontal supporter, wherein the connecting terminal electrically connects printed circuit boards having one ends placed on the first and second areas, respectively.

16 Claims, 7 Drawing Sheets

PRINTED CIRCUIT BOARD CONNECTOR FOR BACK LIGHT UNIT AND CHASSIS USING THE SAME

CROSS-REFERENCE TO RELATED APPLICATIONS

This application claims the priority of Korean Patent Application No. 2007-4665 filed on Jan. 16, 2007, in the Korean Intellectual Property Office, the disclosure of which is incorporated herein by reference.

BACKGROUND OF THE INVENTION

1. Field of the Invention

The present invention relates to a connector, and more particularly, to a connector capable of electrically connecting printed circuit boards (PCBs) for a backlight unit to one another without using soldering, and a chassis for mounting the PCBs thereon.

2. Description of the Related Art

Development of the electronic device industry has led to development of various display devices. Such development has also brought about development of image devices, computers and mobile telecommunication terminals using the display devices. A liquid crystal display (LCD) has emerged in line with this trend and been highlighted as a display for monitors and mobile telecommunication terminals.

Recently as a light source for illuminating the LCD, a backlight unit using a light emitting diode (LED) has been suggested. The LED emits light using luminous phenomenon occurring when a voltage is applied to a semiconductor. The LED is smaller in size and longer in useful life than a conventional light source. Also, the LED is high in energy efficiency due to direct conversion of electrical energy into light energy and low in operational voltage. Therefore, the LED with these advantages is employed as a light source for an LCD backlight module.

This LED backlight unit is obtained generally by mounting a plurality of LEDs on a printed circuit board (PCB). A greater size of the display requires a greater number of LEDs and accordingly a greater size of the PCB for mounting the LEDs thereon.

However, in a case where all the LEDs are mounted on one PCB, a defect in only one of the LEDs necessitates replacement of the PCB. Also, the PCB is prone to warping with increase in size thereof, thus requiring a number of PCBs to be connected together.

FIG. 1 is a perspective view illustrating a conventional connector connecting PCBs for a backlight unit.

Referring to FIG. 1, to electrically connect two PCBs 18*s* and 18*b*, female and male connectors are attached on the PCBs, respectively by a surface mount technology (SMT) and then the connectors are connected to each other.

Here, soldering is essentially required when the female and male connectors connected to circuits of the PCBs are attached on the respective PCBs by the SMT. However, the soldering for connecting the PCBs and connectors 12 entail several problems.

That is, the soldering in the LED BLU requiring electrical connection between the PCBs can be hardly carried out in a clean room, and also increases costs and processes.

Moreover, when PCB terminals are connected by attaching the connectors on the respective PCBs, the connectors have a height much greater than a height of domes of the LEDs mounted on the PCBs, thereby blocking a path of light.

SUMMARY OF THE INVENTION

An aspect of the present invention provides a connector capable of electrically connecting printed circuit boards (PCBs) where light emitting diodes (LEDs) are mounted, without using soldering, while the connector has a height such that a path of light from the LEDs mounted on the PCBs is not interrupted.

According to an aspect of the present invention, there is provided a PCB connector for a backlight unit including: a horizontal supporter; a vertical supporter having one end connected to the horizontal supporter to divide the horizontal supporter into first and second areas; at least one connecting terminal formed on the horizontal supporter to be partially exposed in each of the first and second areas of the horizontal supporter, wherein the connecting terminal electrically connects PCBs having one ends placed on the first and second areas, respectively.

The vertical supporter may be provided at another end thereof with a fixer having a snap fit shape.

The horizontal and vertical supporters each may be formed of an insulating material. The horizontal and vertical supporters each may be formed of plastic.

The connecting terminal may have elasticity to ensure the connector and the PCBs to be electrically connected with stability.

The PCB connector may further include a cover connected to another end of the vertical supporter to be divided into first and second areas by the vertical supporter, and disposed at a predetermined distance from the horizontal supporter to define insertion areas of the PCBs for the backlight unit.

The cover may have a size identical to a size of the horizontal supporter.

The PCB connector may further include at least one connecting terminal formed on the cover to be partially exposed in each of the first and second areas of the cover. The connecting terminal formed on the cover may have elasticity.

The horizontal supporter may further include: at least one connecting protrusion fixing the placed PCBs; a pocket recessed in the horizontal supporter in a predetermined depth to allow the fixing protrusion to be movably fitted therein; and an elastic member formed on the pocket to apply an elastic force to the fixing protrusion.

The elastic member may be a leaf spring. The leaf spring may be U-shaped.

According to another aspect of the present invention, there is provided a chassis for a backlight unit including: a body for arranging a plurality of PCBs thereon; and a plurality of connectors fixed on the body to electrically connect the PCBs to one another, wherein each of the connectors includes: a horizontal supporter; a vertical supporter vertically extended from the horizontal supporter to divide the horizontal supporter into first and second areas; and at least one connecting terminal formed on the horizontal supporter to have one and another ends exposed in the first and second areas of the horizontal supporter, respectively.

The vertical supporter of the connector may be flush with the PCBs.

The chassis may further include a plurality of gap pads formed on an area where the connectors are not fixed. The gap pad is formed flush with the horizontal supporter.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
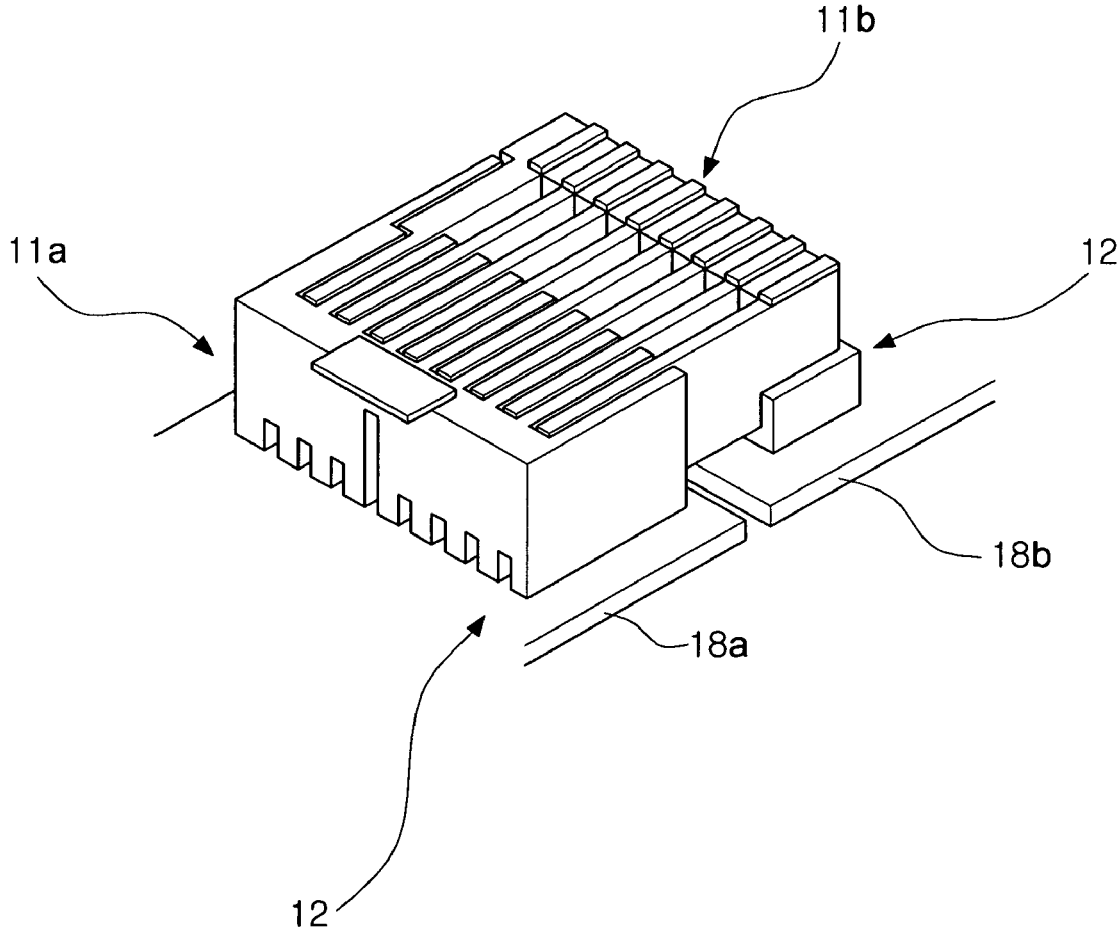
PRIOR ART FIG. 1
FIG. 1 is a perspective view illustrating a conventional printed circuit board (PCB) connector.
Figure 2A:
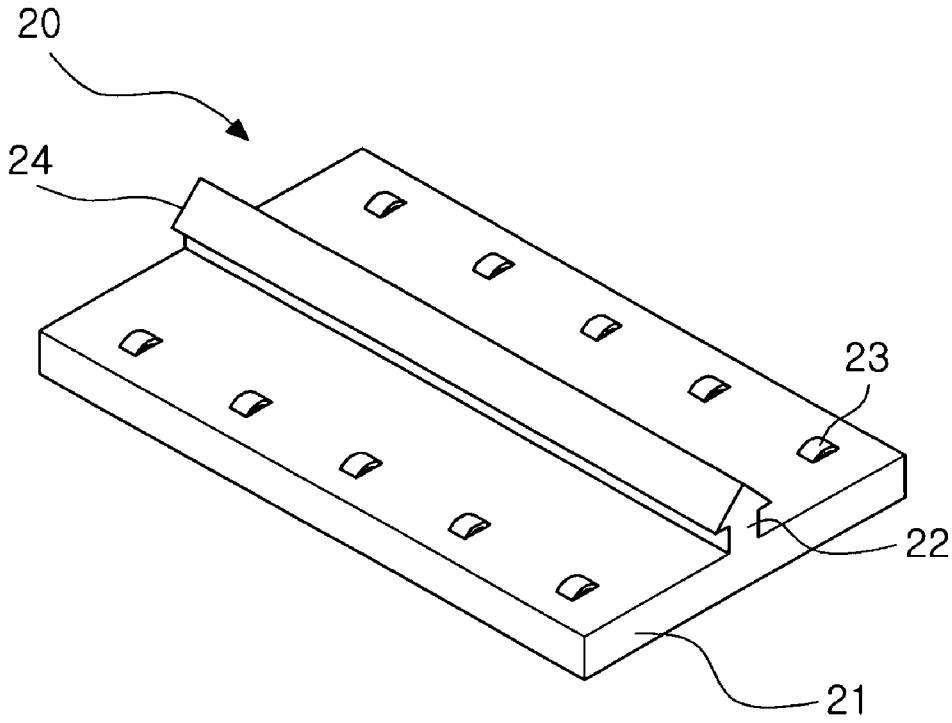
FIG. 2A is a perspective view and FIG. 2B is a cross-sectional view illustrating a PCB connector for a backlight unit, respectively according to an exemplary embodiment of the invention.
Figure 2B:
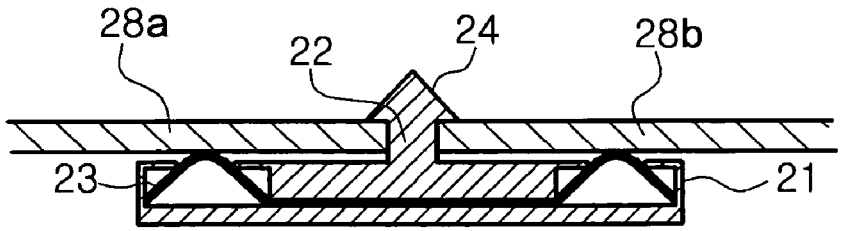

FIG. 2A is a perspective view and FIG. 2B is a cross-sectional view illustrating a connector, respectively according to an exemplary embodiment of the invention.

Referring to FIGS. 2A and 2B, the connector 20 of the present embodiment includes a horizontal supporter 21, a vertical supporter 22 and connecting terminals 23.

A fixer 24 having a snap fit shape may be formed at one end of the vertical supporter 22.

Hereinafter, a "printed circuit board (PCB)" refers to a PCB having light emitting diodes (LEDs) mounted thereon to constitute a backlight unit (BLU).

The horizontal supporter 21 is divided into first and second areas by the vertical supporter 22. PCBs 28*a* and 28*b* having LEDs thereon have one ends placed on the first and second areas, respectively.

Circuit patterns (not shown) are exposed at the one ends of the PCBs 28*a* and 28*b*, and brought in contact with the connecting terminals 23 which each are partially exposed in the first and second areas of the horizontal supporter, respectively.

The horizontal supporter 21 and the vertical supporter 22 each may be formed of an insulator, and particularly, a plastic material.

Each of the connecting terminals 23 is partially exposed in the first and second areas of the horizontal supporter, respectively to electrically connect the PCBs placed on the horizontal supporter to one another.

As shown in FIGS. 2A and 2B, the connecting terminal 23 may be only partially exposed in the first and second areas of the horizontal supporter, respectively. Meanwhile, the connecting terminal has an unexposed portion embedded in the horizontal supporter to be protected from external environment.

The connecting terminals 23 may have elasticity. In the present embodiment, portions of the connecting terminal 23 exposed in the horizontal supporter are shaped as curves. A hole is formed in a predetermined depth in the horizontal supporter so that the curved portions of the connecting terminal are elastically movable. The connecting terminal may be shaped variously as long as the terminal comes in electrical contact with the circuit patterns of the PCBs placed.

The fixer 24 shaped as a snap fit may be formed at the one end of the vertical supporter 22. The snap fit-shaped fixer 24 fixes the connector to the PCBs.

That is, when the PCBs 28*a* and 28*b* are fixedly arranged on a body (not shown) at a predetermined distance from each other, the connector 20 where the snap fit-shaped fixer is formed is inserted between the PCBs to be physically fixed to the PCBs 28*a* and 28*b*.

The snap fit-shaped fixer 24 allows the PCBs arranged at a distance to be more tightly fixed to the connector 20, thereby stabilizing electrical connection between the PCBs.

The snap fit-shaped fixer 24 formed at the one end of the vertical supporter 22 may be formed of a plastic material identical to the vertical supporter.

In the present embodiment, the snap-fit shaped fixer 24 is triangular but may be varied in shape as long as the fixer functions to fix the PCBs to the connector.

Figure 3A:
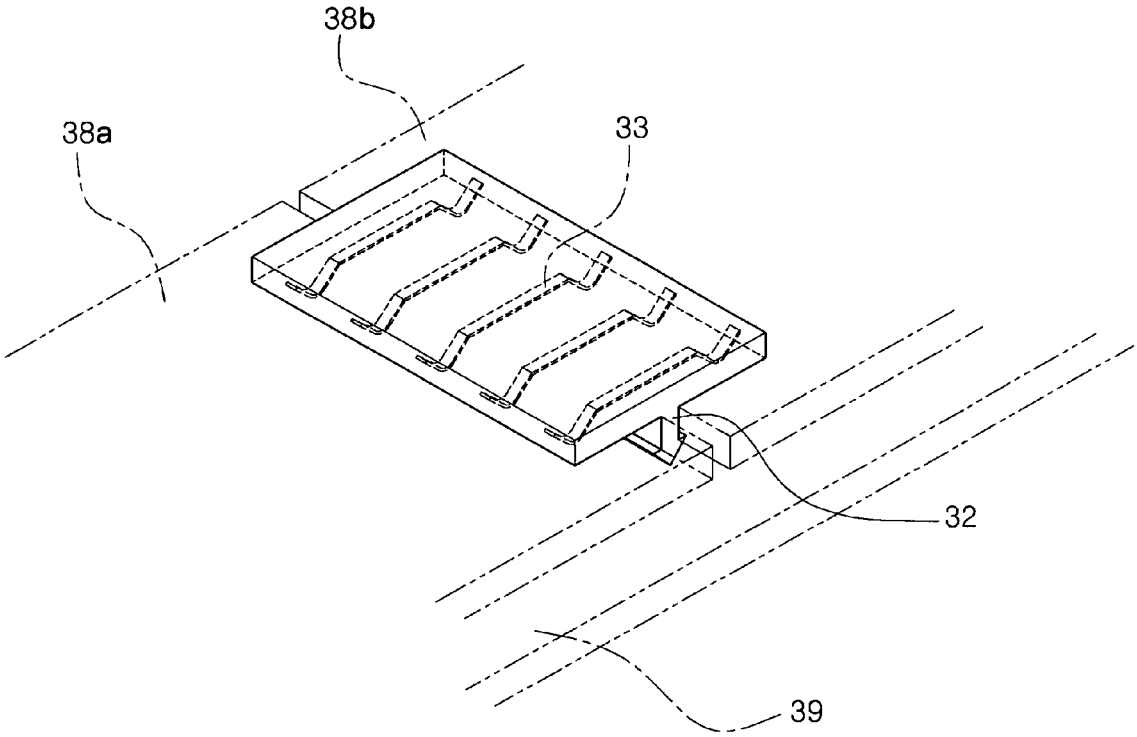
FIG. 3A is a perspective view and FIG. 3B is a cross-sectional view illustrating a PCB connector for a backlight unit, respectively according to an exemplary embodiment of the invention.
Figure 3B:
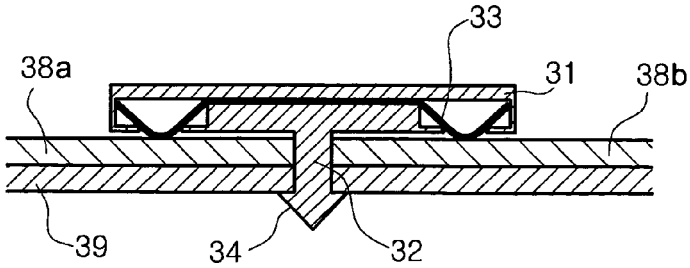

FIG. 3A is a perspective view and FIG. 3B is a cross-sectional view illustrating PCBs arranged on a body using a connector, respectively according to an exemplary embodiment of the invention.

Referring to FIGS. 3A and 3B, the connector of the present embodiment includes a horizontal supporter 31, a vertical supporter 32 and connecting terminals 33.

A snap fit-shaped fixer 34 may be formed at one end of the vertical supporter 32.

In the connector of the present embodiment, the vertical supporter 32 may have a height equivalent to a total thickness of the PCBs 38*a* and 38*b* and the body 39.

To enable the connector of the present embodiment to be applicable, the PCBs 38*a*, and 38*b* are arranged at a predetermined distance from each other on the body 39. LEDs (not shown) are arranged on the PCBs 38*a* and 39*b* to be utilized as a light source of a BLU. The LEDs are electrically connected to one another by circuit patterns formed on the PCBs to constitute a circuit.

A hole is formed in the body 39 so that the snap fit-shaped fixer 34 formed at one end of the vertical supporter is inserted therein. The PCBs are disposed on the body and then the snap fit-shaped fixer 34 of the connector is inserted into the hole of the body to fix the PCBs.

In the embodiment of FIG. 2, the PCBs are electrically connected to each other by the connector, while being fixed to the body. On the other hand, in the embodiment of FIG. 3, even though the PCBs are not fixed to the body, the PCBs can be fixed onto the body and electrically connected to each other using the connector.

Figure 4A:
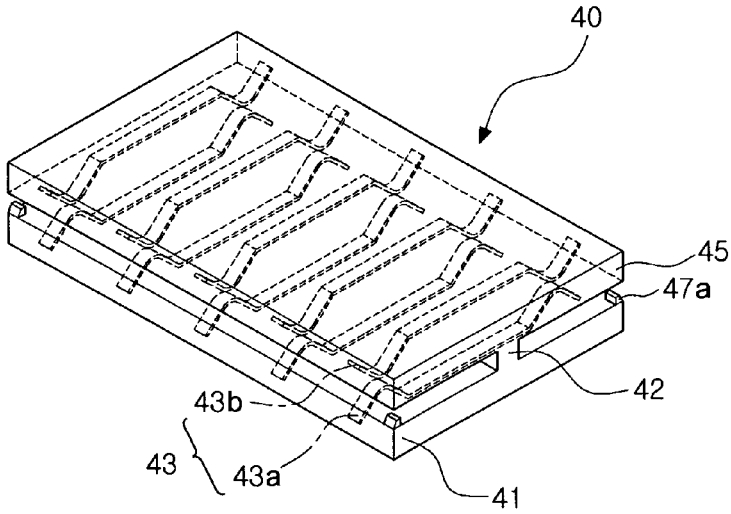
FIG. 4A is a perspective view and FIG. 4B is a cross-sectional view illustrating a PCB connector for a backlight unit, respectively according to another exemplary embodiment of the invention.
Figure 4B:
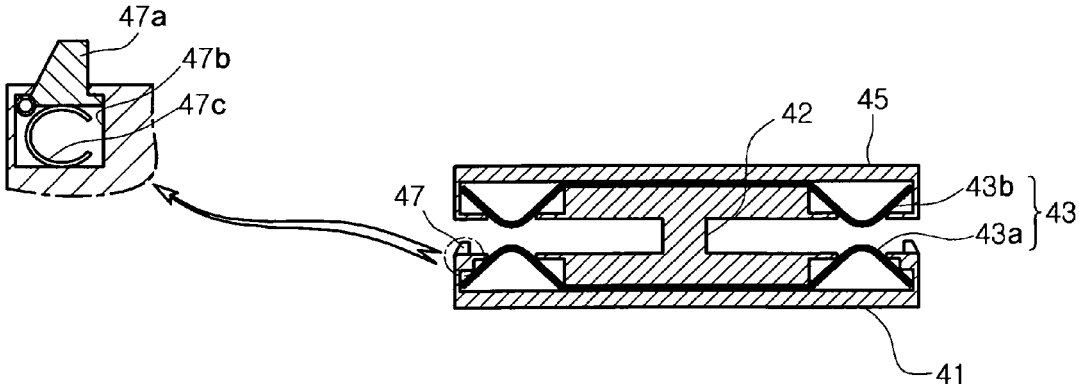

FIG. 4A is a perspective view and FIG. 4B is cross-sectional view illustrating a connector, respectively according to another exemplary embodiment of the invention.

Figure 5A:
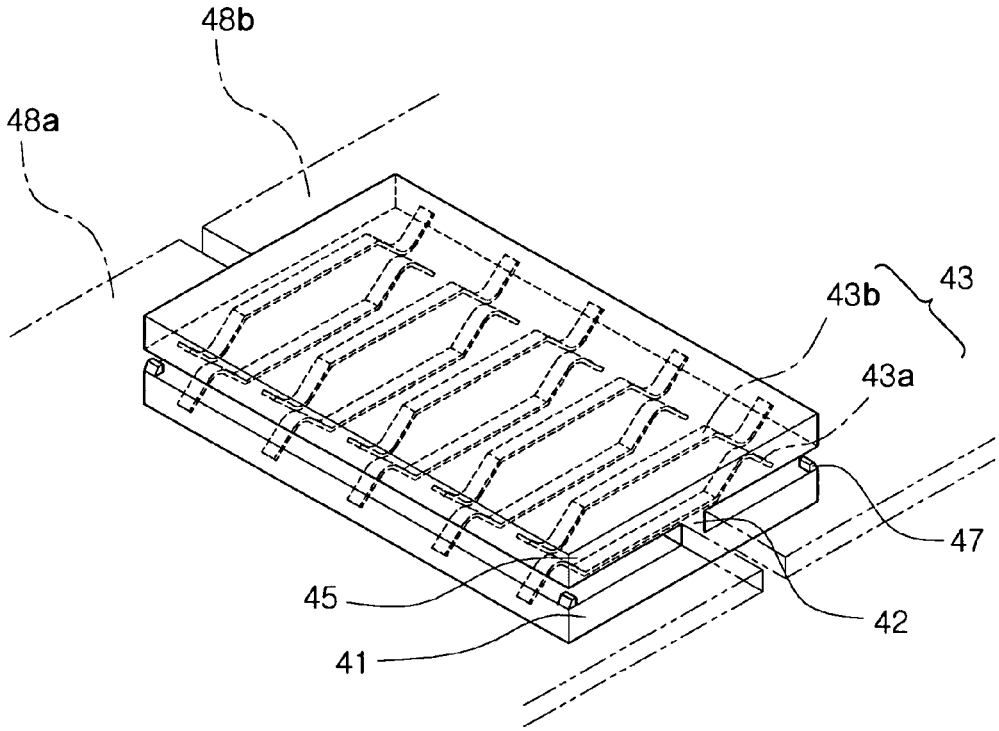
FIG. 5A is a perspective view and FIG. 5B is a plan view illustrating PCBs connected by connectors of FIG. 4, respectively according to an exemplary embodiment of the invention.
Figure 5B:
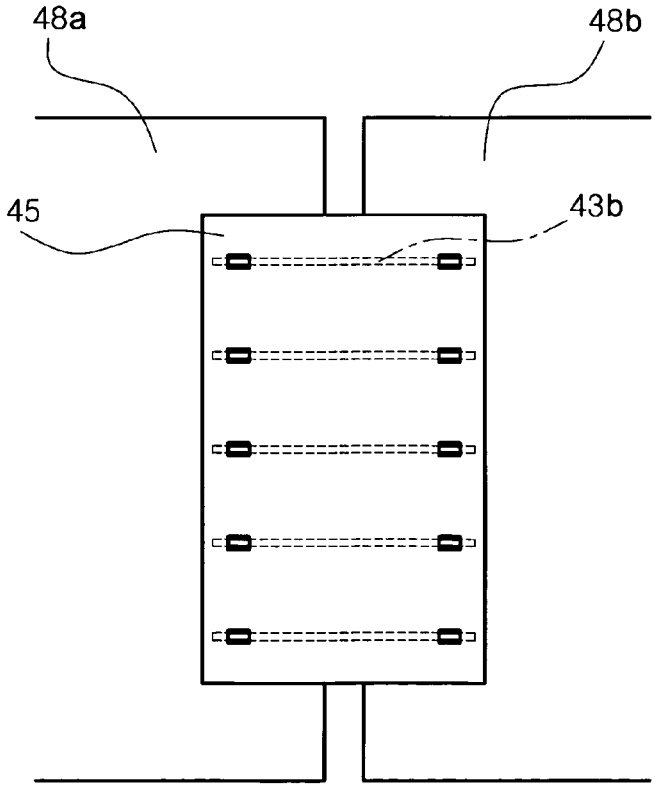

FIG. 5A is a perspective view and FIG. 5B is a plan view illustrating PCBs connected by the connector of FIG. 4.

Referring to FIGS. 4A and 4B, the connector 40 of the present embodiment includes a horizontal supporter 41, a vertical supporter 42, connecting terminals 43*a* and a cover 45.

The cover 45 may further include connecting terminals 43*b*.

On a surface of the horizontal supporter 41 where the PCBs are placed, connecting protrusions 47*a* may be formed to fix the PCBs.

The horizontal supporter 41 is divided into first and second areas by the vertical supporter 42 extended vertically from the horizontal supporter. The cover 45 is formed on another end of the vertical supporter to be spaced apart from the horizontal supporter at a predetermined distance.

Accordingly, the horizontal supporter 41 and the cover 45 define insertion areas of the PCBs. Therefore, a spacing between the horizontal supporter 41 and the cover 45 may be identical to a thickness of the PCBs inserted.

The horizontal supporter 41, the vertical supporter 42 and the cover 45 each may be formed of an insulating material, and particularly, an elastic plastic material.

Each of the connecting terminals 43*a* is partially exposed in the first and second areas of the horizontal supporter 41, respectively to electrically connect the PCBs placed on the horizontal supporter to each other.

Moreover, the connecting terminals 43*b* may be formed on the cover 45 to be applicable when the circuit patterns are formed on both surfaces of the respective PCBs inserted.

Each of the connecting terminals 43 may be partially exposed in the first and second areas of the horizontal supporter 41 and the cover 45, respectively, and have unexposed portions embedded in the horizontal supporter 41 and the cover 45 to be protected from external environment.

As in the present embodiment, the cover 45 of an identical size to the horizontal supporter 41 prevents the connecting terminal exposed in the horizontal supporter 41 from being exposed outward. Accordingly, in a case where the connector itself is stored and handled, exposed portions of the connecting terminal can be prevented from external environment.

The connecting terminal 43 may have elasticity. Also, in the present embodiment, the portions of the connecting terminal 43 exposed in the horizontal supporter and the cover are formed in curves. Holes of a predetermined depth are formed in the horizontal supporter and the cover so that the curves of the connecting terminal are elastically movable. The connecting terminal may be varied in shape as long as the terminal comes in electrical contact with the circuit patterns of the PCBs placed.

On a surface of the horizontal supporter 41 where the PCBs are placed, the connecting protrusions 47*a* may be formed to fix the PCBs.

A pocket 47*b* is formed in the horizontal supporter 41 so that each of the fixing protrusions is movably fitted therein. Also, a U-shaped leaf spring 47*c* is installed on the fixing protrusion to apply an elastic force.

The fixing protrusion 47*a* is thrust into the pocket 47*b* while not obstructing the PCBs from being inserted during the insertion thereof. But when the PCBs are fully inserted, the fixing protrusion 47*a* is fitted into a fixing hole formed in the PCBs due to an elastic force applied from the leaf spring 47*c*, thereby fixing the PCBs.

This connecting protrusion formed on the connector allows the PCBs to be fixed tightly by the connector before the PCBs are mounted on the body.

In the present embodiment, the fixing protrusions are formed on respective corners of the horizontal supporter 41 but may be varied in number and configuration as long as the fixing protrusions function to fix the PCBs. The fixing protrusions may be formed on the cover 45.

Referring to FIGS. 5A and 5B, two PCBs 48*a* and 48*b* are inserted in insertion areas defined by the horizontal supporter 41 and the cover 45, respectively. Fixing holes (not shown) are formed in the PCBs 48*a*, and 48*b* so that fixing protrusions formed on the horizontal supporter are fitted thereinto.

Circuit patterns formed on top and bottom of each of the PCBs are electrically connected together by connecting terminals formed on the horizontal supporter 41 and the cover 45 of the connector.

Figure 6:
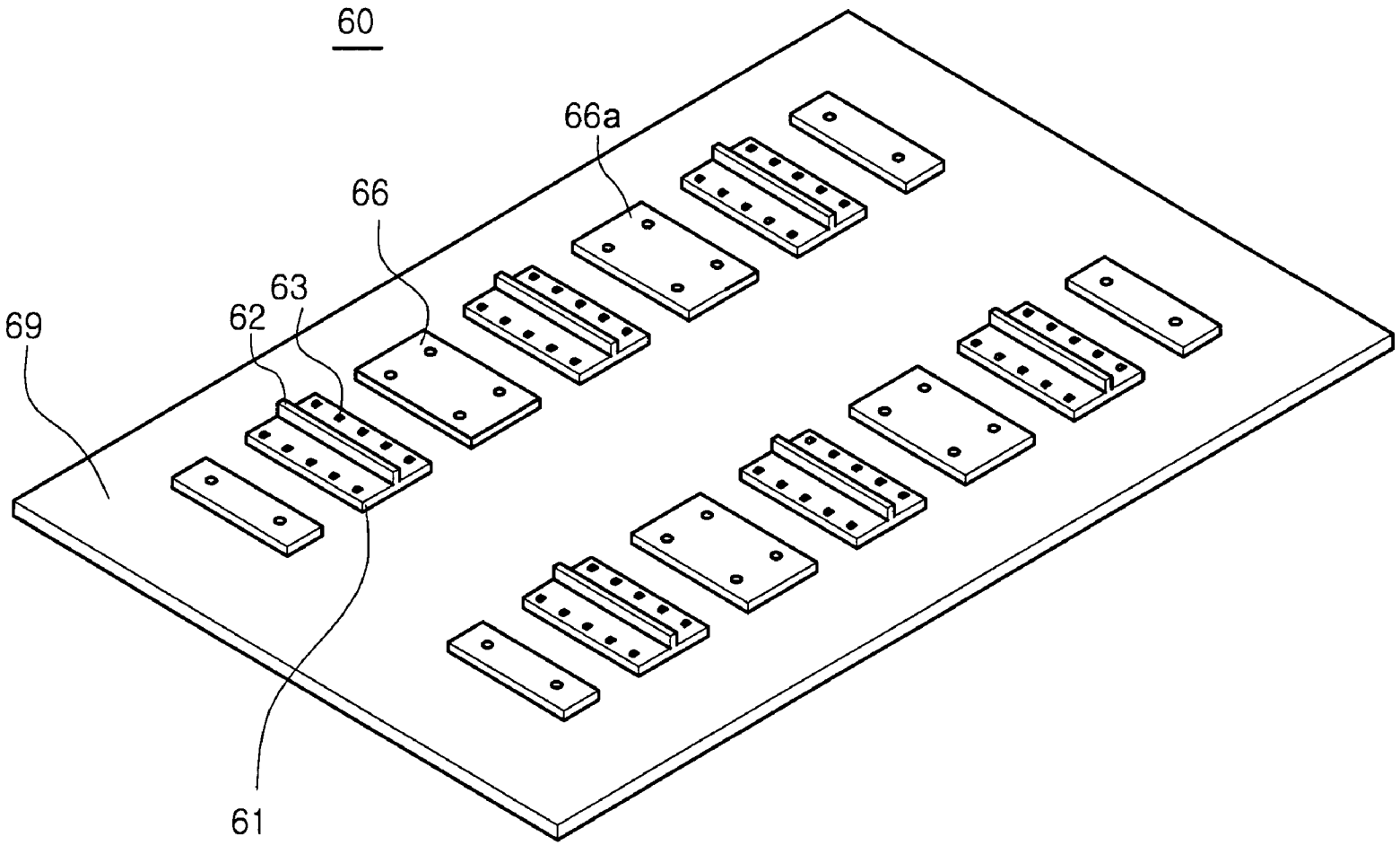
FIG. 6 is a perspective view illustrating a chassis for a backlight unit according to an exemplary embodiment of the invention.

FIG. 6 is a perspective view illustrating a chassis for mounting PCBs thereon which has a connector attached thereon according to an exemplary embodiment of the invention.

Figure 7:
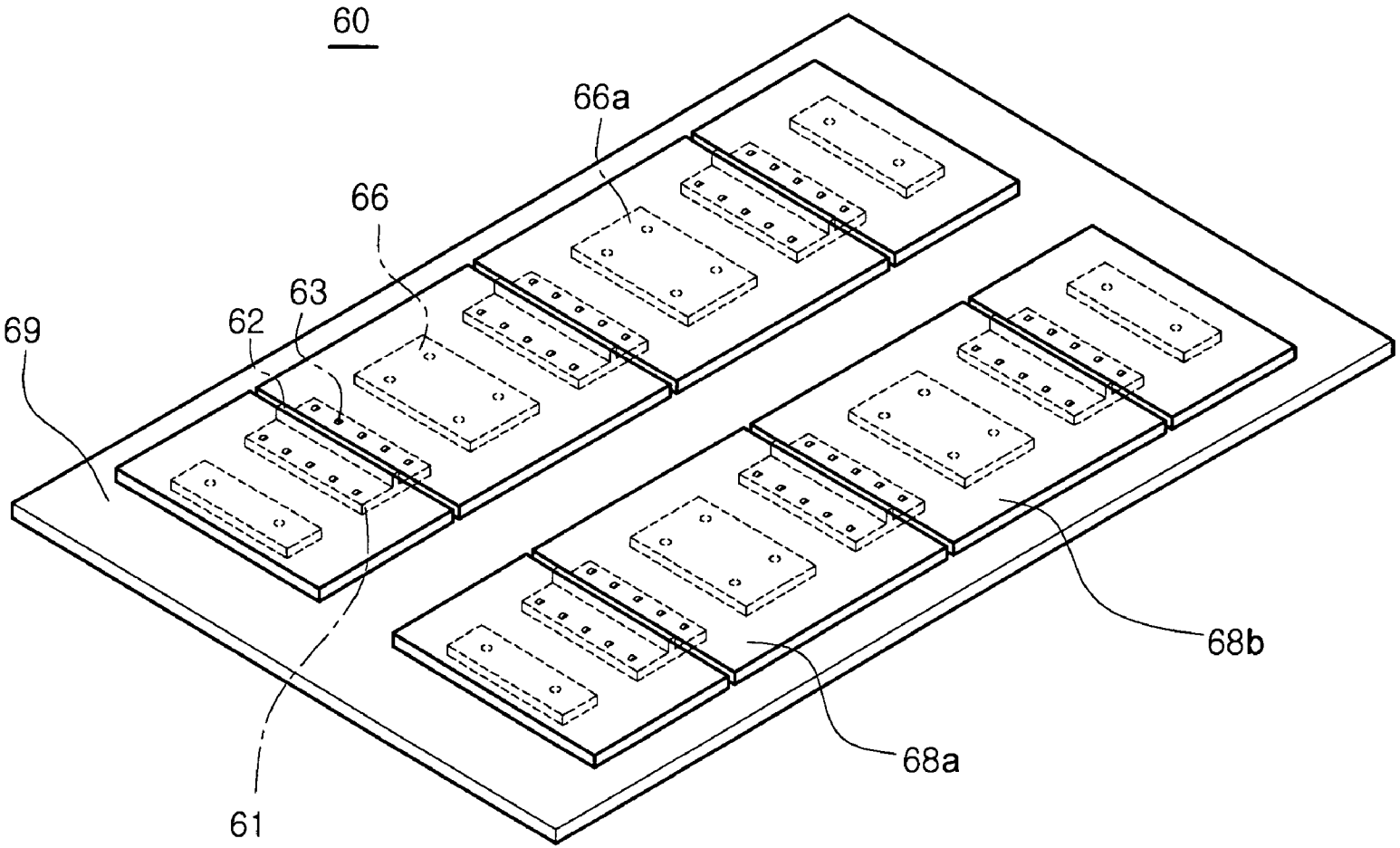
FIG. 7 is a perspective view illustrating PCBs mounted on the chassis of FIG. 6 according to an exemplary embodiment of the invention.

FIG. 7 is a perspective view illustrating PCBs mounted on the chassis of FIG. 6.

Referring to FIG. 6, the chassis 60 of the present embodiment includes a body 69 for mounting PCBs thereon and connectors for electrically connecting the PCBs arranged on the body together.

The body of the chassis 69 provides an area where the PCBs are mounted and may have holes formed therein to fix the PCBs.

Each of the connectors attached to the body of the chassis includes a horizontal supporter 61, a vertical supporter 62 and connecting terminals 63.

The horizontal supporter 61 is divided into first and second areas by the vertical supporter 62, and each of the connecting terminals is partially exposed in the first and second areas, respectively to electrically connect the PCBs together.

The vertical supporter 62 may have a thickness identical to a thickness of each of the PCBs mounted. The vertical supporter 62 having such a predetermined height as above, as shown in FIG. 7, prevents the connector from being formed higher than a top of the PCB, thereby not blocking a path of light emitted from LEDs (not shown) mounted on the PCB.

In FIG. 7, PCBs 68*a* and 68*b* mounted on the chassis may be fixed to the body 69 of the chassis using an additional fixing unit. This is because the connector of the present embodiment electrically connects but not mechanically fixes the PCBs.

Gap pads 66 may be further formed on a top of the chassis body 69.

The gap pads 66 may be formed on portions of the top of the chassis body 69 where the connector is not formed.

The gap pads 66 are employed to compensate for a different height of the horizontal supporter 61 of the connector with respect to a surface of the chassis body 69. Therefore, the gap pads 66 each may have a thickness identical to a thickness of the horizontal supporter 61. Screw holes 66*a* may be formed in the respective gap pads 66 to fix the PCBs mounted thereon.

As described above, the present invention is not limited to the aforesaid embodiments and the drawings attached. That is, the snap fit and fixing protrusion may be varied in shape.

As set forth above, according to exemplary embodiments of the invention, PCBs for mounting LEDs thereon to constitute a BLU are connected together without using soldering, thereby simplifying a manufacturing process. Also, the connector for connecting the PCBs is minimized in height to maximally ensure a path of light emitted from the LEDs.

While the present invention has been shown and described in connection with the exemplary embodiments, it will be apparent to those skilled in the art that modifications and variations can be made without departing from the spirit and scope of the invention as defined by the appended claims.

What is claimed is:

1. A printed circuit board connector for a backlight unit comprising:

a horizontal supporter;

a vertical supporter having one end connected to the horizontal supporter to divide the horizontal supporter into first and second areas;

at least one connecting terminal formed on the horizontal supporter to be partially exposed in each of the first and second areas of the horizontal supporter, wherein the connecting terminal electrically connects printed circuit boards having one ends placed on the first and second areas, respectively.

2. The printed circuit board connector of claim 1, wherein the vertical supporter is provided at another end thereof with a fixer having a snap fit shape.

3. The printed circuit board connector of claim 1, wherein the horizontal and vertical supporters each are formed of an insulating material.

4. The printed circuit board connector of claim 3, wherein the horizontal and vertical supporters each are formed of plastic.

5. The printed circuit board connector of claim 1, wherein the connecting terminal has elasticity.

6. The printed circuit board connector of claim 1, further comprising a cover connected to another end of the vertical supporter to be divided into first and second areas by the vertical supporter, and disposed at a predetermined distance from the horizontal supporter to define insertion areas of the printed circuit boards for the backlight unit.

7. The printed circuit board connector of claim 6, wherein the cover has a size identical to a size of the horizontal supporter.

8. The printed circuit board connector of claim 6, further comprising at least one connecting terminal formed on the cover to be partially exposed in each of the first and second areas of the cover.

9. The printed circuit board connector of claim 8, wherein the connecting terminal formed on the cover has elasticity.

10. The printed circuit board connector of claim 6, wherein the horizontal supporter further comprises:

at least one connecting protrusion fixing the placed printed circuit boards;

a pocket recessed in the horizontal supporter in a predetermined depth to allow the fixing protrusion to be movably fitted therein; and an elastic member formed on the pocket to apply an elastic force to the fixing protrusion.

11. The printed circuit board of claim 10, wherein the elastic member is a leaf spring.

12. The printed circuit board of claim 11, wherein the leaf spring is U-shaped.

13. A chassis for a backlight unit comprising:

a body for arranging a plurality of printed circuit boards thereon; and a plurality of connectors fixed on the body to electrically connect the printed circuit boards to one another, wherein each of the connectors comprises:

a horizontal supporter;

a vertical supporter vertically extended from the horizontal supporter to divide the horizontal supporter into first and second areas; and at least one connecting terminal formed on the horizontal supporter to have one and another ends exposed in the first and second areas of the horizontal supporter, respectively.

14. The chassis of claim 13, wherein the vertical supporter of the connector is flush with the printed circuit boards.

15. The chassis of claim 3, further comprising a plurality of gap pads formed on an area where the connectors are not fixed.

16. The chassis of claim 15, wherein the gap pad is formed flush with the horizontal supporter.

* * * * *